US007131888B2

(12) United States Patent
Hsu

(10) Patent No.: US 7,131,888 B2
(45) Date of Patent: Nov. 7, 2006

(54) BRA CUPS WITHOUT SEWING SEAMS

(75) Inventor: Cheng-Hsien Hsu, Yuan-Kang (TW)

(73) Assignee: Chi-Shang Enterprise Ltd., Tainan County (TW)

( * ) Notice: Subject to any disclaimer, the term of this patent is extended or adjusted under 35 U.S.C. 154(b) by 0 days.

(21) Appl. No.: 10/929,388

(22) Filed: Aug. 31, 2004

(65) Prior Publication Data

US 2006/0046614 A1 Mar. 2, 2006

(51) Int. Cl.
*A41C 3/00* (2006.01)
*A41C 3/10* (2006.01)

(52) U.S. Cl. ..... 450/39; 450/41

(58) Field of Classification Search ..... 450/1, 450/39, 41, 46, 47, 43, 49, 51, 52, 57, 92–94, 450/97, 109; 2/78.7–78.4, 73, 243.1, 400; 156/245, 73.1, 60, 73.4, 73.3, 88; 264/152–155, 264/157, 257, 258, 291, 292, 294, 320, 321, 264/163, 145, 148, 160
See application file for complete search history.

(56) References Cited

U.S. PATENT DOCUMENTS

| | | | | | |
|---|---|---|---|---|---|
| 2,915,067 | A | * | 12/1959 | Bracht | 450/45 |
| 4,080,416 | A | * | 3/1978 | Howard | 264/258 |
| 4,148,322 | A | * | 4/1979 | Jacaruso et al. | 450/40 |
| 4,372,321 | A | * | 2/1983 | Robinson | 450/39 |
| 5,447,462 | A | * | 9/1995 | Smith et al. | 450/122 |
| 5,820,443 | A | * | 10/1998 | Burr | 450/40 |
| 5,916,829 | A | * | 6/1999 | Girard et al. | 442/244 |
| 6,000,994 | A | * | 12/1999 | Salotto | 450/92 |
| 6,425,800 | B1 | * | 7/2002 | Huang | 450/41 |
| 6,837,771 | B1 | * | 1/2005 | Falla | 450/39 |

* cited by examiner

*Primary Examiner*—Gloria M. Hale
(74) *Attorney, Agent, or Firm*—Rosenberg, Klein & Lee

(57) ABSTRACT

A cup structure for bras includes an inner layer, a middle layer and an outer layer, wherein the middle layer is sandwiched between the inner layer and the outer layer. The inner layer and the outer layer are connected with each other by heat-pressing or gluing so as to form non-seam cups.

2 Claims, 4 Drawing Sheets

BRA CUPS WITHOUT SEWING SEAMS

FIELD OF THE INVENTION

The present invention relates to a bra cup which includes an outer layer and an inner layer which is connected to the outer layer by heat-pressing.

BACKGROUND OF THE INVENTION

A conventional bra generally includes two cups connected by a connection plate and two side plates respectively extend from the two cups so as to be hooked with each other on the back of the wearers. Two shoulder straps are connected between the corresponding pair of cup and side plate. The cups each include a foam lining, a shape wire located at a lower edge of each cup, an inner layer and an outer layer. The foam lining is sandwiched between the inner layer and the outer layer which is sewed to the outer layer. Although the sewing provides better connection to the inner layer and the outer layer, seams are visible if the wearers wear a tight top and the threads could be loosened or broken after repeatedly washing.

The present invention intends to provide a cup structure of a bra and the inner layer and the outer layer are connected with each other by way of heat-pressing which creates a non-seam outer surface for the cups.

SUMMARY OF THE INVENTION

The present invention relates to cup structure for bras and the cup includes an outer layer, a middle layer which is sandwiched between the outer layer and an inner layer. The middle layer includes a lining with two curved edges and a connection plate which includes two concave curved recesses such that the lining is sewn to the connection plate by sewing the two curved convex edges along the two curved recesses. The outer layer is connected to the inner layer by heat-pressing.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
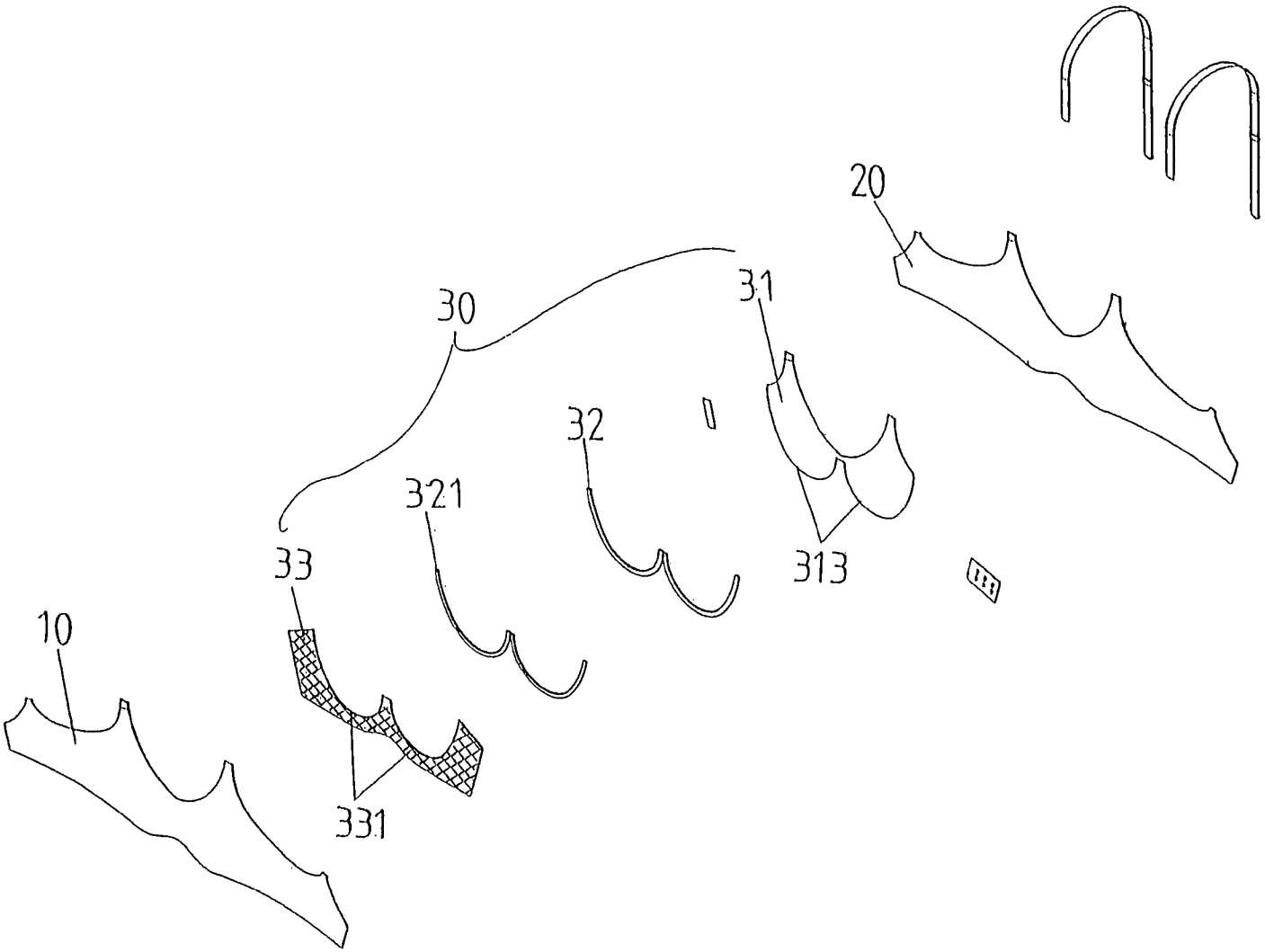
FIG. 1 is an exploded view to show the bra of the present invention.
Figure 2:
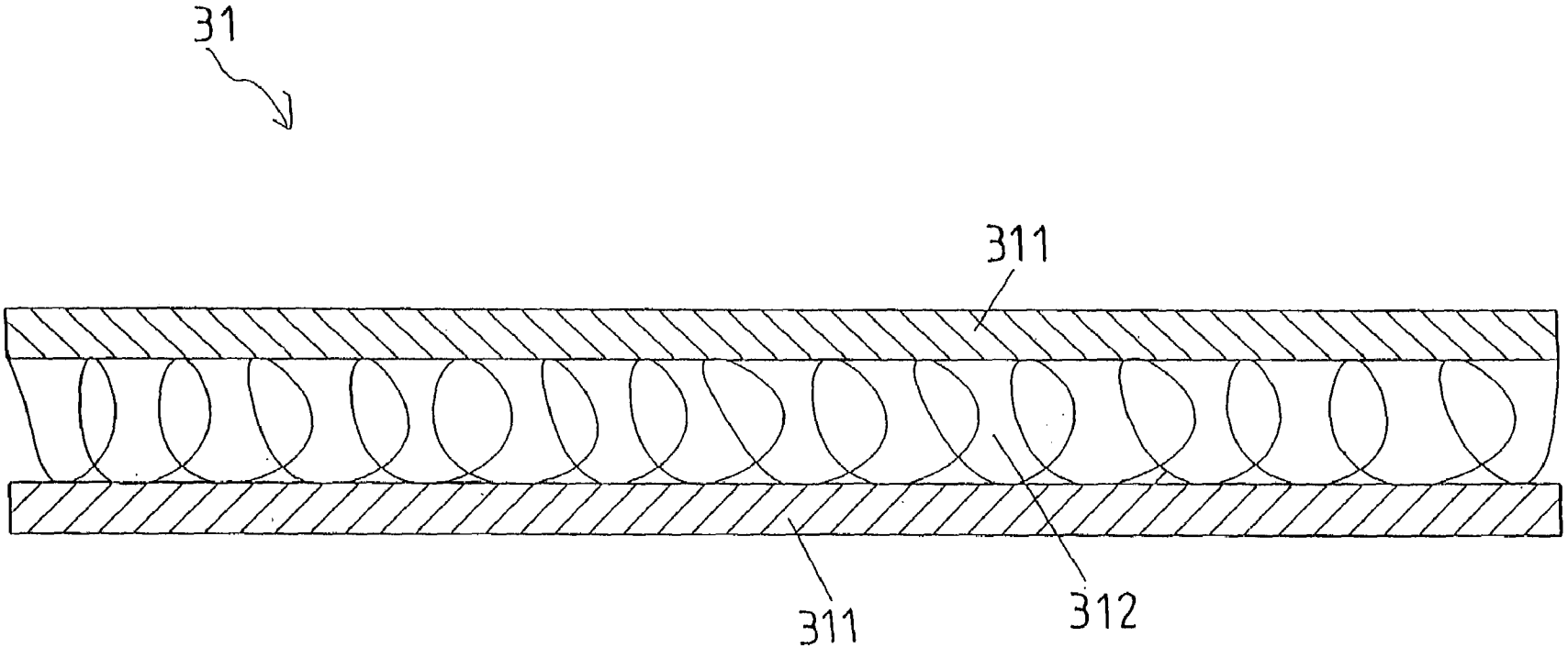
FIG. 2 is a cross sectional view to show the lining of the middle layer of the bra of the present invention.
Figure 3:
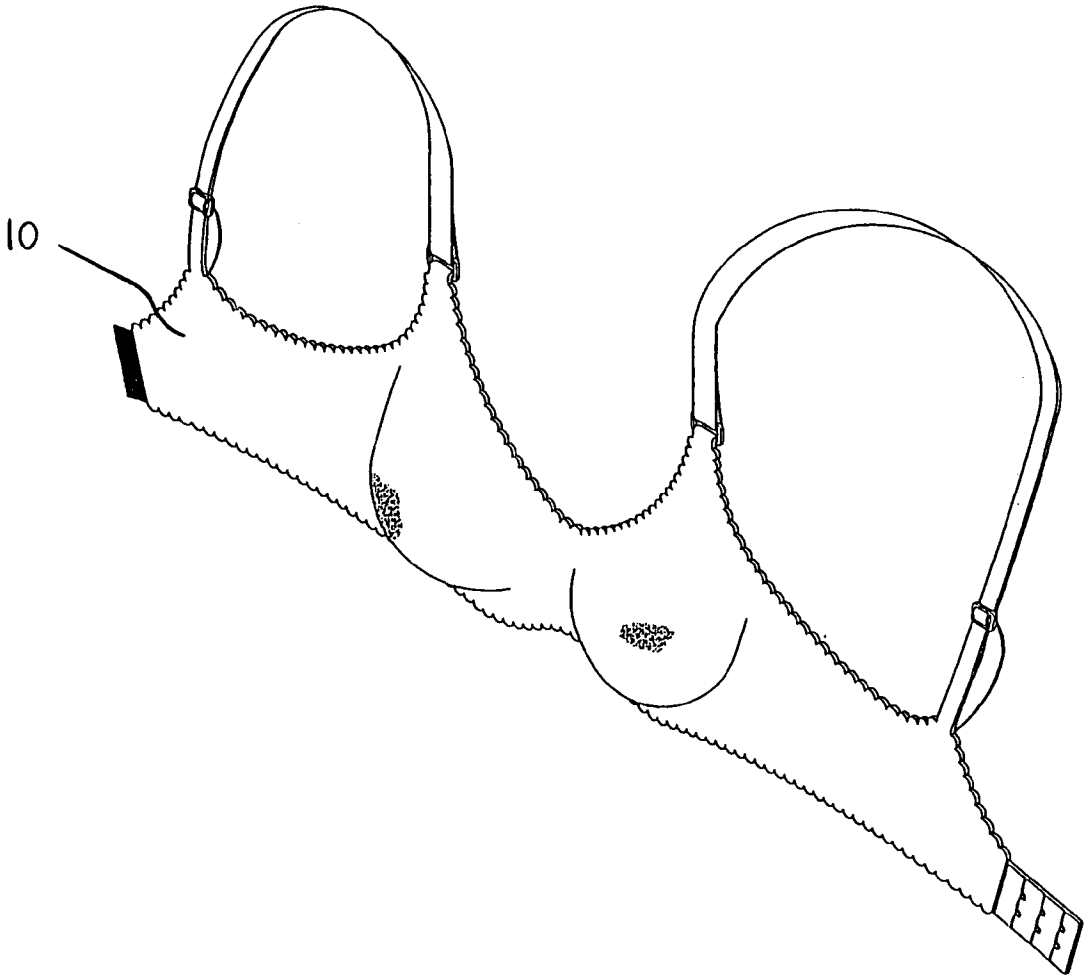
FIG. 3 is a perspective view, seen from outside of the bra of the present invention.
Figure 4:
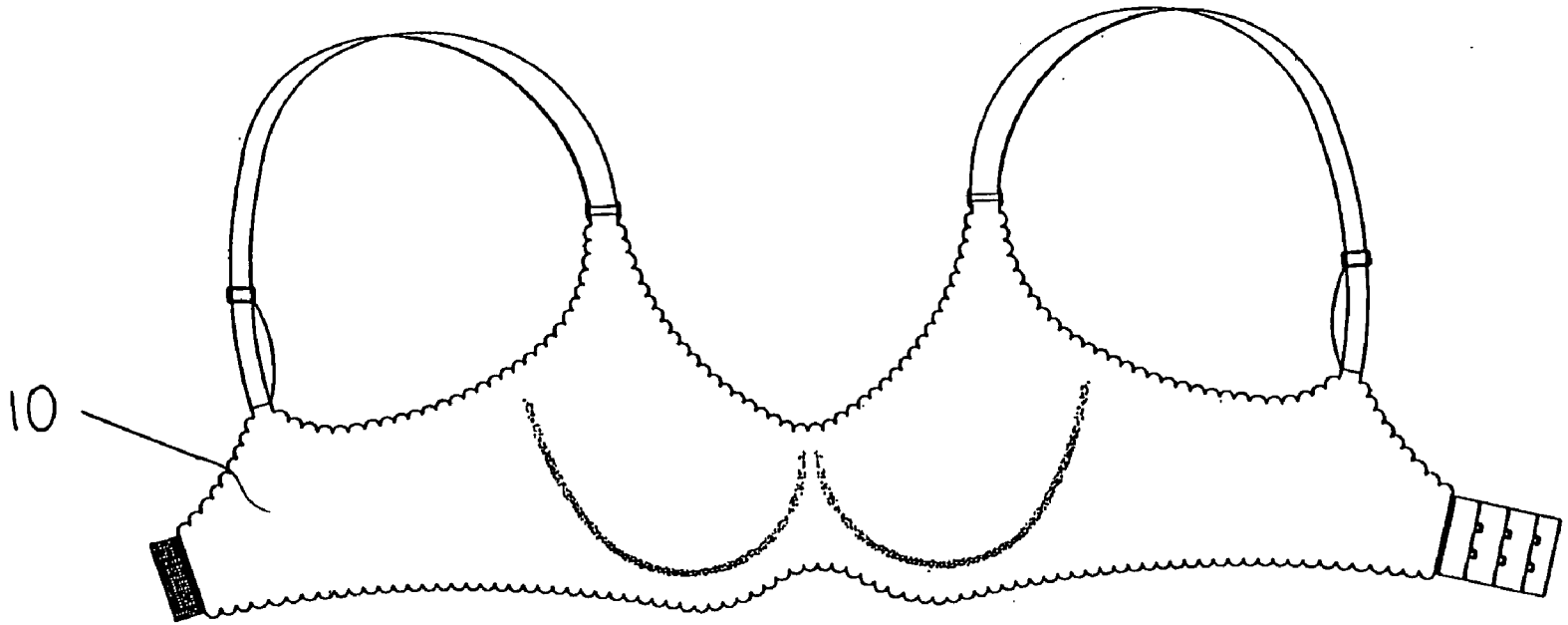
FIG. 4 is a perspective view, seen from inside of the bra of the present invention.

Referring to FIGS. 1 to 4, the bra of the present invention comprises two cups and each cup includes an outer layer 10, a middle layer 30 and an inner layer 20, wherein the middle layer 30 is sandwiched between the outer layer 10 and the inner layer 20. The middle layer 30 includes a lining 31 with two curved convex edges 313 and a connection plate 33 which includes two concave curved recesses 331 so that the lining 31 is sewed to the connection plate 33 by sewing the two curved convex edges 313 along the two concave recesses 331. The lining 31 includes two surface cotton sheets 311, 311 and a fiber texture layer 312 is located between the two surface cotton sheets 311, 311. Two shape wires 321 are received in two tubes 32 which are secured to the two curve curved edges 313 of the lining 31 so as to provide support to the cups.

The outer layer 10 is connected to the inner layer 20 by heat-pressing or gluing which creates non-seam outer surface. Ultra-sonic wave is used to trim the periphery of the cups.

The bras can be made much easier and quicker than the conventional ones. There will be no worry for the threads visible or loosened. The bras of the present invention are suitable for mass production and the fiber texture layer 312 of the lining 31 prevents the bras from being deformed.

While we have shown and described the embodiment in accordance with the present invention, it should be clear to those skilled in the art that further embodiments may be made without departing from the scope of the present invention.

What is claimed is:

1. A brassiere laminated cup structure, comprising:

an outer layer, a middle layer and an inner layer, the middle layer including a lining with two curved convex edges and a connection plate, the connection plate including two concave curved recesses and the lining being sewn to the connection plate by sewing the two curved convex edges of the lining along the two concave curved recesses of the connection plate, the middle layer being sandwiched between the outer layer and the inner layer and, the outer layer being connected to the inner layer by heat-pressing.

2. The cup structure as claimed in claim 1, wherein two shape wires are received in two tubes which are secured to the two curved convex edges.

* * * * *